United States Patent [19]

Emmenthal et al.

[11] Patent Number: 4,818,199

[45] Date of Patent: Apr. 4, 1989

[54] SPIRAL DISPLACEMENT MACHINE FOR COMPRESSIBLE MEDIA WITH EMBOSSED SHEET METAL SEAL STRIP

[75] Inventors: Klaus-Dieter Emmenthal; Claus Müller; Otto Schäfer, all of Wolfsburg, Fed. Rep. of Germany

[73] Assignee: Volkswagen AG, Wolfsburg, Fed. Rep. of Germany

[21] Appl. No.: 114,548

[22] Filed: Oct. 28, 1987

[30] Foreign Application Priority Data

Oct. 28, 1986 [DE] Fed. Rep. of Germany ..... 3636628

[51] Int. Cl.[4] ..... F01C 1/04; F01C 19/02; F16J 15/16; F16J 15/447

[52] U.S. Cl. ..... 418/55; 418/141; 418/144; 277/53; 277/204; 277/207 R

[58] Field of Search ..... 418/55, 141, 143, 144, 418/156, 178; 277/53, 159, 204, 207 R

[56] References Cited

U.S. PATENT DOCUMENTS

| | | | |
|---|---|---|---|
| 3,600,114 | 8/1971 | Dvorak et al. | 418/55 |
| 4,646,694 | 3/1987 | Fawcett | 418/144 |

FOREIGN PATENT DOCUMENTS

| | | | |
|---|---|---|---|
| 3141525 | 5/1983 | Fed. Rep. of Germany . | |
| 1071851 | 2/1984 | U.S.S.R. | 277/53 |
| 2021209 | 11/1979 | United Kingdom | 277/53 |

*Primary Examiner*—John J. Vrablik

*Attorney, Agent, or Firm*—Brumbaugh, Graves, Donohue & Raymond

[57] ABSTRACT

A displacement machine for compressible media, with at least one displacement chamber arranged in a stationary housing and rendered in the manner of a groove extending with a spiral shape, and with a band-shaped or tongue-shaped displacement body associated with each displacement chamber and likewise rendered in spiral shape is described. The displacement body is held on a discoid rotor, which can be driven eccentrically relative to the housing, in such a manner that during operation, each of its outside wall points performs a circular movement bounded by the peripheral walls of the displacement chamber. The curvature of the displacement body relative to the curvature of the displacement chamber is dimensioned such that the displacement body nearly comes in contact with the radially inner and outer peripheral walls of the displacement chamber. For sealing the radial gap formed between the stationary housing and the rotor a sheet metal strip with a roughness applied in a precisely targeted fashion is held on one of the surfaces of the components to be sealed. In order to create an arrangement which can be produced as simply and easily as possible, the sheet metal strip is to be provided with outwardly projecting scale-like embossings and said sheet metal strip is to be constituted by an aluminum foil cemented on to the component.

8 Claims, 2 Drawing Sheets

SPIRAL DISPLACEMENT MACHINE FOR COMPRESSIBLE MEDIA WITH EMBOSSED SHEET METAL SEAL STRIP

BACKGROUND OF THE INVENTION

The present invention relates to a displacement machine for compressible media. In particular to a machine having at least one displacement chamber-arranged in a stationary housing and rendered in the manner of a groove which extends in a spiral shape. There is a band or tongue shaped displacement body associated with each displacement chamber and likewise rendered in spiral shape. The displacement body is held on a discoid rotor, which can be driven eccentrically in relation to the housing and in such a manner that during operation, each of the displacement bodies outside wall points performs a circular movement bounded by the peripheral walls of the displacement chamber. The displacement body's curvature relative to the curvature of the displacement chamber is dimensioned such that it nearly comes in contact with the radially inner and outer peripheral walls of the displacement chamber at one or more continuously advancing lines of sealing. For sealing the radial gap formed between the stationary housing and the rotor, a sheet metal strip having a roughness applied in a precisely targeted fashion, is held on one of the surfaces where the sealing is to occur.

A displacement machine constructed in such a fashion is known, e.g., from DE-OS No. 31 41 525. According to the latter, a seal is produced at least on one of the component surfaces by means of an application of a sheet metal strip with a targeted roughness whose roughness peaks are to be plastically deformable or removable when the machine is first operated. The seal is largely self-adjusting as the components nearly come into contact with one another. Said seal results in a minimal clearance and a favorable labyrinth effect. Since each point of the displacement body in each case collaborates only with precisely defined points of the housing, the deformation or removal process occurring when the machine is first operated results in the setting of a clearance which is optimally adjusted to the prevailing local conditions.

SUMMARY OF THE INVENTION

It is an object of the invention to further develop the above known arrangement and thereby to insure in particular a simple and low cost production thereof.

This object is attained in that the known sheet metal strip, which seals the radial gap formed between the stationary housing and the rotor, is provided with scale-like embossings projecting towards the outside. Accordingly, the invention proposes the fixing on the outside wall of the component, preferably by cementing or the like, of a simple sheet metal strip constituted suitably of aluminum foil and provided with scale-like embossings arranged at an angle with respect to the tangential direction. The production of such a sheet metal or foil strip provided with embossings is extremely simple and economical and occurs, e.g., in the manufacture of heat exchangers for the obtention of air conduction fins. Utilization of a foil strip provided with embossings to serve as a sealing element in displacement machines results in an excellent sealing effect whereby return flow losses are avoided. This technique also leads to a substantial reduction in the tolerance requirements on the manufacturing of the spiral components.

BRIEF DESCRIPTION OF THE DRAWINGS

The invention will be more fully explained in the following description of the preferred embodiment, as represented in the accompanying drawings, in which.

DESCRIPTION OF THE PREFERRED EMBODIMENT

Figure 1:
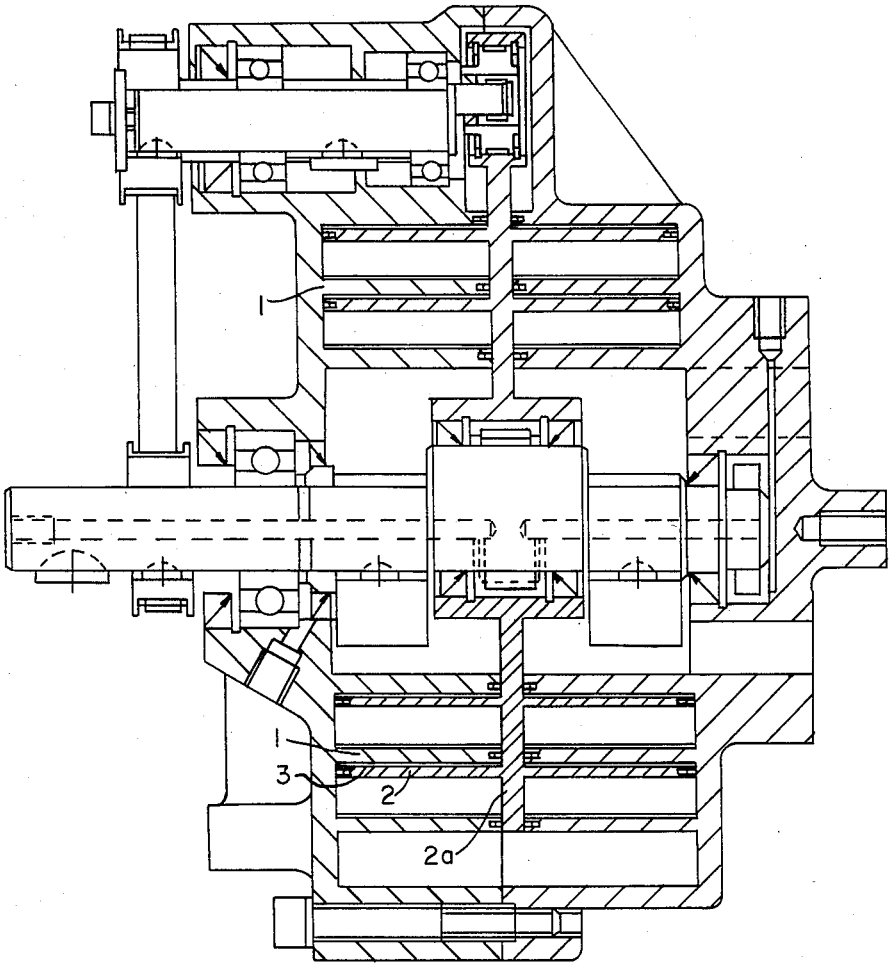
FIG. 1 is a vertical sectional view through a representative spiral displacement machine of the type in which the present invention may be utilized.
Figure 2:
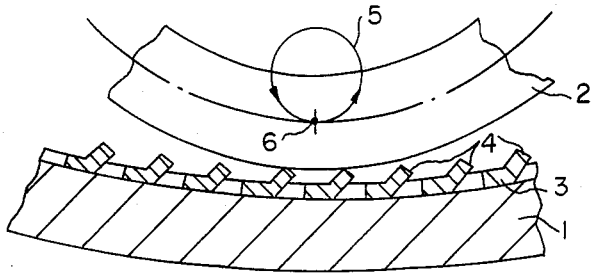
FIG. 2 is a fragmentary longitudinal sectional view illustrating the sealing conditions between one wall of a spiral displacement chamber and a spiral displacement body in a displacement machine embodying the invention.

The spiral displacement machine illustrated in FIG. 1 is the type shown in DE-OS No. 31 41 525 and is designed with a spiral-shaped wall portion 1, shown here in cross-section through the spiral and shown in FIG. 2 in fragmentary longitudinal section flat, at both sides of which wall portion are formed displacement chambers rendered in the manner of a groove extending in a spiral shape. A displacement body 2, also illustrated in FIG. 1 in cross-section through the spiral and in FIG. 2 in fragmentary longitudinal section, mates with one of the displacement chambers and is likewise rendered in a spiral shape so that during operation, due to the eccentric drive of a rotor 2*a* holding the displacement body 2, each point of said displacement body 2 performs essentially a circular movement. This circular movement is indicated in FIG. 2 by 5 for a point 6 located approximately on the center line of the displacement body 2.

During this circular movement, the displacement body 2 touches the two peripheral walls of the displacement chamber surrounding it at one or more lines of sealing as it advances continuously during operation through the displacement chamber. In order to avoid frictional losses the contact is merely a near-contact, i.e., the smallest possible gap remains between the displacement body 2 and the displacement chamber wall or housing spiral 1.

As shown in the drawing, for sealing the minor gap, a strip 3 constituted by a sheet metal or foil material, preferably of aluminum, covers the entire axial depth. Said strip is provided with scale-like embossings 4 extending essentially axially and is fixed on the outside wall of the housing spiral 1, facing the displacement body 2.

Figure 3:
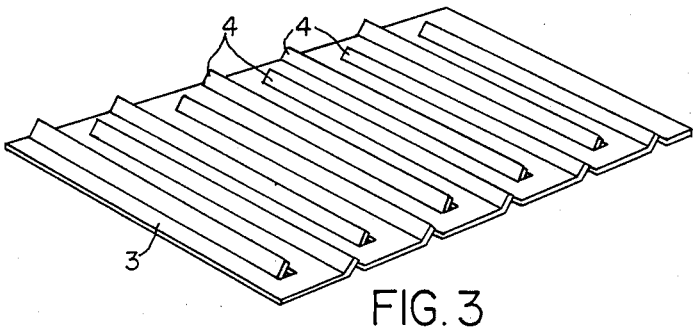
FIG. 3 is a perspective view showing one form of sheet metal strip provided with scale-like embossings for use in forming a seal between a displacement chamber wall and a displacement body in accordance with the invention.

In FIG. 3 is shown such a strip 3 consisting of aluminum foil with scale-like embossings 4. Said strip is fixed by cementing or possibly also by soldering, or the like, said strip onto the outer wall of the housing spiral 1 facing the displacement body 2. The scale-like embossings 4 provided on this foil strip are to seal the gap remaining between the displacement body 2 and the housing spiral 1. The embossings 4 are deformed on contact with the displacement body 2 and are bent back to a defined position. The embossings 4 prevent return flow losses between the individual working chambers which form along the displacement chamber between the displacement body and the housing spiral. They do so without any contact which would cause abrasion between the two components. The foil strips cemented on to the spiral housing walls therefor reduce the relatively narrow tolerance requirements which can be adhered to only at considerable cost in the production of the displacement bodies and the housing spiral.

As a variation of the aforedescribed embodiment, where the sheet metal strip is to be constituted by aluminum foil, there may be a special advantage to produce the sheet metal strip with thin spring steel material. In such a case, the scale-like embossings would form fine leaf spring elements which could adjust elastically to changes of the gap dimension.

Figure 4:
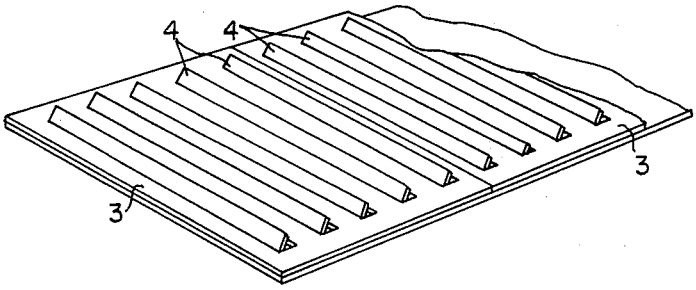
FIG. 4 is a perspective view illustrating another form of sheet metal strip for use in the invention.

In such a case in particular, i.e., where a thin spring steel strip is cemented on to the outside wall of the component, consisting, e.g., of a light metal and constituting, e.g., the housing spiral, thermal expansion differences may be produced. In order to prevent this, the metal strips may be divided into individual segments over the length of the spiral. These individual segments may be applied at a distance from one another on to an adhesive foil, as shown in FIG. 4, which is directly cemented on to the component. The "expansion gaps" to be provided between the individual segments may then absorb a possibly generated differential expansion.

Expansion problems, however, may also be avoided by providing, in place of the individual metal strip segments, scale-like embossings applied on to the metal strip by means of an offset arrangement. This arrangement would be in such a manner that no web regions would be formed which in a straight line extend continuously through the entire longitudinal direction of the spiral and apply themselves flush against the component as is the case along the longitudinal edges of the sheet metal strip 3 shown in FIG. 3. If the scale-like embossings 4 are arranged offset relative to one another, only sections of longitudinal web regions cemented on or applied to the component would be created which would shift with respect to one another when relative expansion occurs.

While the invention has been illustrated and described as embodied in a displacement machine for compressible media, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A displacement machine for compressible media, comprising a stationary housing having at least one displacement chamber rendered in the manner of a groove extending with a spiral shape, a band-shaped displacement body associated with each displacement chamber and likewise rendered in spiral shape, a discoid rotor supporting the displacement body for eccentric motion in relation to the housing so that, during operation, each of the displacement body's outside wall points performs a circular movement bounded by peripheral walls of the displacement chamber, the curvature of the displacement body relative to the curvature of the displacement chamber being arranged so that the displacement body nearly comes in contact with and forms a radial gas with radially inner and outer peripheral walls of the displacement chamber at least one line of sealing which advances continuously during operation, and a sheet metal strip between the displacement body and a wall of the displacement chamber having outwardly projecting scale-like embossings so as to seal the radial gap therebetween.

2. A displacement machine as defined in claim 1, wherein the embossings are pitched at an angle relative to a tangential direction of an outer contour of one of the displacement body and the wall of the displacement chamber.

3. A displacement machine as defined in claim 1, wherein the sheet metal strip is an aluminum foil cemented onto one of the displacement body and the wall of the displacement chamber.

4. A displacement machine as defined in claim 1, wherein the sheet metal strip is constituted by spring steel material and the scale-like embossings are rendered as leaf spring elements.

5. A displacement machine as defined in claim 1, wherein the sheet metal strip is divided, at least longitudinally, into individual segments arranged at a distance from one another.

6. A displacement machine as defined in claim 5, wherein an adhesive foil directly applied to one of the displacement body and the wall of the displacement chamber is provided as support for the individual segment.

7. A displacement machine as defined in claim 1 wherein the scale-like embossings are offset relative to one another on the sheet metal strip in such a manner that the sheet metal strip does not contain any longitudinal web region extending continuously in a straight line and applying itself flush against one of the displacement body and the wall of the displacement chamber.

8. A displacement machine for compressible media, comprising:

at least one displacement chamber which is arranged in a stationary housing and rendered in the manner of a groove extending in spiral shape having peripheral walls;

a displacement body associated with each displacement chamber and likewise rendered in a spiral shape;

a discoid rotor provided so as to hold said displacement body and being eccentrically driveable relative to the housing in such a manner that during operation, each of the displacement body's outside wall points performs a circular movement bounded by the peripheral walls of the displacement chamber and whose curvature relative to the curvature of the displacement chamber is dimensioned such that it nearly comes in contact with and forms a radial gap with radially inner and outer peripheral walls of the displacement chamber at one or more lines of sealing as it advances continuously during operation; and a sheet metal strip having outwardly projecting scale-like embossings wherein the embossings are pitched at an angle relative to the tangential direction of an outer contour of a component so as to seal the radial gap formed between the stationary housing and the rotor.

* * * * *